US005486856A

United States Patent [19]

Katsuma et al.

[11] Patent Number: 5,486,856

[45] Date of Patent: Jan. 23, 1996

[54] COLOR THERMAL PRINTER

[75] Inventors: Nobuo Katsuma; Satoshi Ueda; Hiroyuki Matsukawa, all of Saitama, Japan

[73] Assignee: Fuji Photo Film Co., Ltd., Kanagawa, Japan

[21] Appl. No.: 277,624

[22] Filed: Jul. 20, 1994

[30] Foreign Application Priority Data

Jul. 22, 1993 [JP] Japan ..... 5-181480

[51] Int. Cl.[6] ..... B41J 2/32; B41M 5/28; B41M 5/34

[52] U.S. Cl. ..... 347/175; 347/212

[58] Field of Search ..... 347/172, 174, 347/175, 212; 400/120.01, 120.02, 120.03

[56] References Cited

U.S. PATENT DOCUMENTS 5,268,707 12/1993 Katsuma et al. ..... 347/212

5,424,761 6/1995 Imai ..... 347/212

*Primary Examiner*—Huan H. Tran

*Attorney, Agent, or Firm*—Birch, Stewart, Kolasch & Birch

[57] ABSTRACT

A recording sheet, to be printed in a color thermal printer, includes a support and thermosensitive coloring layers of yellow, magenta and cyan formed thereon, the three coloring layers arranged from an obverse toward a reverse of the recording sheet. The recording sheet is rotated to pass under a thermal head. The rotation subjects the three coloring layers sequentially to thermal recording. With a sensor, 1st irradiance of a yellow fixing lamp is measured, as well as 2nd irradiance of a magenta fixing lamp. A target irradiance is determined from the 1st irradiance. A duty factor of a drive signal is redetermined from the 1st irradiance and the target irradiance, to actuate the yellow fixing lamp at the target irradiance. A 1st speed is previously adapted to the yellow coloring layer. The yellow fixing lamp is maintained at the target irradiance. The recording sheet is rotated at the 1st speed, for the recording to the yellow coloring layer. A 2nd speed is determined from the 1st irradiance. The recording sheet is rotated at the 2nd speed, for supplementary fixation of the yellow coloring layer with the yellow fixing lamp. A 3rd speed is previously adapted to the magenta coloring layer. The recording sheet is rotated at the 3rd speed with the 2nd irradiance maintained, for the recording to the magenta coloring layer. A 4th speed is determined from the 2nd irradiance. The recording sheet is rotated at the 4th speed, for supplementary fixation of the magenta coloring layer with the magenta fixing lamp.

29 Claims, 9 Drawing Sheets

FIG. 5A

| MEASURED IRRADIANCE LY | ROTATING SPEED (pps) | |
|---|---|---|
| | SY1 (1ST ROTATION) | SY2 (2ND ROTATION) |
| 84≦LY | 336.0 | ——— |
| 69≦LY<84 | | 1539.7 |
| 64≦LY<69 | | 1048.9 |
| 58.8≦LY<64 | | 743.2 |

FIG. 5B

| MEASURED IRRADIANCE LM | ROTATING SPEED (pps) | |
|---|---|---|
| | SM1 (3RD ROTATION) | SM2 (4TH ROTATION) |
| 50≦LM | 205.0 | ——— |
| 44.2≦LM<50 | | 1555.7 |
| 40≦LM<44.2 | | 811.7 |
| 35≦LM<40 | | 437.4 |

FIG. 5C

| MEASURED IRRADIANCE LM | ROTATING SPEED (pps) | |
|---|---|---|
| | SC1 (5TH ROTATION) | SC2 (6TH ROTATION) |
| 50≦LM | 289.0 | ——— |
| 44.2≦LM<50 | | 1555.7 |
| 40≦LM<44.2 | | 1151.1 |
| 35≦LM<40 | | 638.2 |

| MEASURED IRRADIANCE LY | TARGET IRRADIANCE LS |
|---|---|
| 84≦LY | 84 |
| 69≦LY<84 | 69 |
| 64≦LY<69 | 64 |
| 58.8≦LY<64 | 58.8 |

| MEASURED IRRADIANCE LM | BLEACHING TIME Ts (sec) AT CLAMPED EDGE |
|---|---|
| $50 \leqq LM$ | 4.0 |
| $44.2 \leqq LM < 50$ | 5.5 |
| $40 \leqq LM < 44.2$ | 6.5 |
| $35 \leqq LM < 40$ | 7.5 |

COLOR THERMAL PRINTER

BACKGROUND OF THE INVENTION

1. Field of the Invention

The present invention relates to a color thermal printer in which color thermosensitive recording material is fixed by ultraviolet rays. More particularly, the present invention relates to an improvement of a color thermal printer in which ultraviolet rays for the fixation can be controlled effectively.

2. Description Related to the Prior Art

A color thermal printer, as disclosed in U.S. Pat. No. 4,734,704, is used with color thermosensitive recording material, which consists of cyan (C), magenta (M) and yellow (Y) thermosensitive coloring layers formed on a support. The printer applies heat to the recording material to record a full-color image thermally in direct fashion. One of the coloring layers disposed on an obverse of the recording material is subjected to the thermal recording at first. The thermal recording is performed through the coloring layers successively in the order toward the support or the reverse of the recording material. Should a coloring layer be not fixed, it would receive unwanted extra heat from the subsequent thermal recording. Any coloring layer must be fixed before a subsequent layer can be subjected to the thermal recording. For the fixation of each coloring layer, ultraviolet rays in a range of a predetermined wavelength are applied to the layer directly after the thermal recording, to destroy the coloring ability of the layer.

The color thermal printer has a platen drum on which the recording material is supported. The platen drum is rotated at a regular speed. During one rotation, the thermal recording and the optical fixation are performed. A speed of the rotation of the platen drum is determined in consideration of heat sensitivity of each coloring layer.

If the speed of the platen drum is determined somewhat high in consideration of the thermal recording, there is an occasion in which the rotation commonly used for the fixation is excessively fast. There is a problem in that ultraviolet rays applied in the rotation are insufficient for fixing the coloring layer to destroy the coloring ability.

If the speed of the platen drum is determined somewhat low for the thermal recording, there is an occasion in which the rotation is too slow for the fixation. The ultraviolet rays applied in the rotation are excessive for the fixation. There is a problem in that a weaker component included in the ultraviolet rays unexpectedly fix a subsequent or final coloring layer. The image quality of the color thermal recording is seriously influence.

SUMMARY OF THE INVENTION

In view of the foregoing problems, an object of the present invention is to provide a color thermal printer in which fixation of the thermosensitive recording material is stabilized without influencing the image quality according to the thermal recording.

In order to achieve the above and other objects and advantages of this invention, color thermosensitive recording material, to be printed in a color thermal printer, includes a support and first to third thermosensitive coloring layers formed thereon, the first to third coloring layers arranged toward the support from an obverse of the recording material. Relative movement is caused between the recording material and a thermal head relative to one another. The relative movement subjects the first to third coloring layers to thermal recording sequentially in an order listed. A first ultraviolet lamp is actuated for optical fixation of the first coloring layer in the thermal recording. A second ultraviolet lamp is actuated for optical fixation of the second coloring layer in the thermal recording. With a sensor, a first irradiance of the first lamp is measured, while actuated by a first drive signal set at a duty factor. With said sensor, a second irradiance of the second lamp is measured, while actuated by a second drive signal set at an unchanged duty factor. A target irradiance is determined in accordance with the first irradiance. The duty factor of the first drive signal is redetermined in accordance with the first irradiance and the target irradiance, the first deive signal supplied to the first lamp, to actuate the first lamp at the target irradiance. A first relative speed is determined in accordance with heat sensitivity of the first coloring layer. The first lamp is maintained at the target irradiance. The relative movement of the recording material is caused at the first speed, for the thermal recording to the first coloring layer through the thermal head, and for fixing said first layer with said first lamp after said thermal recording. A second relative speed is determined in accordance with the first irradiance. The relative movement of the recording material is caused at the second speed, for supplementary fixation of the first coloring layer with the first lamp. A third relative speed is determined in accordance with heat sensitivity of the second coloring layer. The relative movement of the recording material is caused at the third speed with the second irradiance maintained, for the thermal recording to the second coloring layer through the thermal head, and for fixing said second coloring layer with said second lamp after said thermal recording. A fourth relative speed is determined in accordance with the second irradiance. The relative movement of the recording material is caused at the fourth speed, for supplementary fixation of the second coloring layer with the second lamp.

The ultraviolet rays applied in the rotation can be sufficient for fixing the coloring layer, without failure in destroying the coloring ability. Also, no extra ultraviolet rays are applied to the recording material for the fixation. No problem occurs as the ultraviolet rays would not fix a subsequent or final coloring layer. The image quality of the color thermal recording is kept high.

Conventionally, it could be conceived in a color thermal printer to stabilize the ultraviolet intensity despite the external environmental influence to the intensity. A sensor could be disposed near to each lamp for detecting ultraviolet irradiance. The rotational speed of the platen drum might be lowered or heightened in accordance with the irradiance of the emanated ultraviolet rays. To adapt the recording to the fixation at the adjusted speed of the rotation, it would be possible to control the heating operation of the thermal head. However, this idea would inevitably have a problem in having parameters in too great a number, to make it highly difficult to control the printing sequence.

In the present invention, there is no change in operation of the thermal head. Therefore, it is easy to control the fixation in a well-stabilized manner.

BRIEF DESCRIPTION OF THE DRAWINGS

The above objects and advantages of the present invention will become more apparent from the following detailed description when read in connection with the accompanying drawings, in which:

FIGS. 5A to 5C are tables illustrating a relationship between a measured irradiance and a rotational speed, wherein FIG. 5A is a table for a yellow coloring layer, FIG. 5B is a table for a magenta coloring layer, and FIG. 5C is a table for a cyan coloring layer;

DETAILED DESCRIPTION OF THE PREFERRED EMBODIMENT(S) OF THE PRESENT INVENTION

Figure 1:
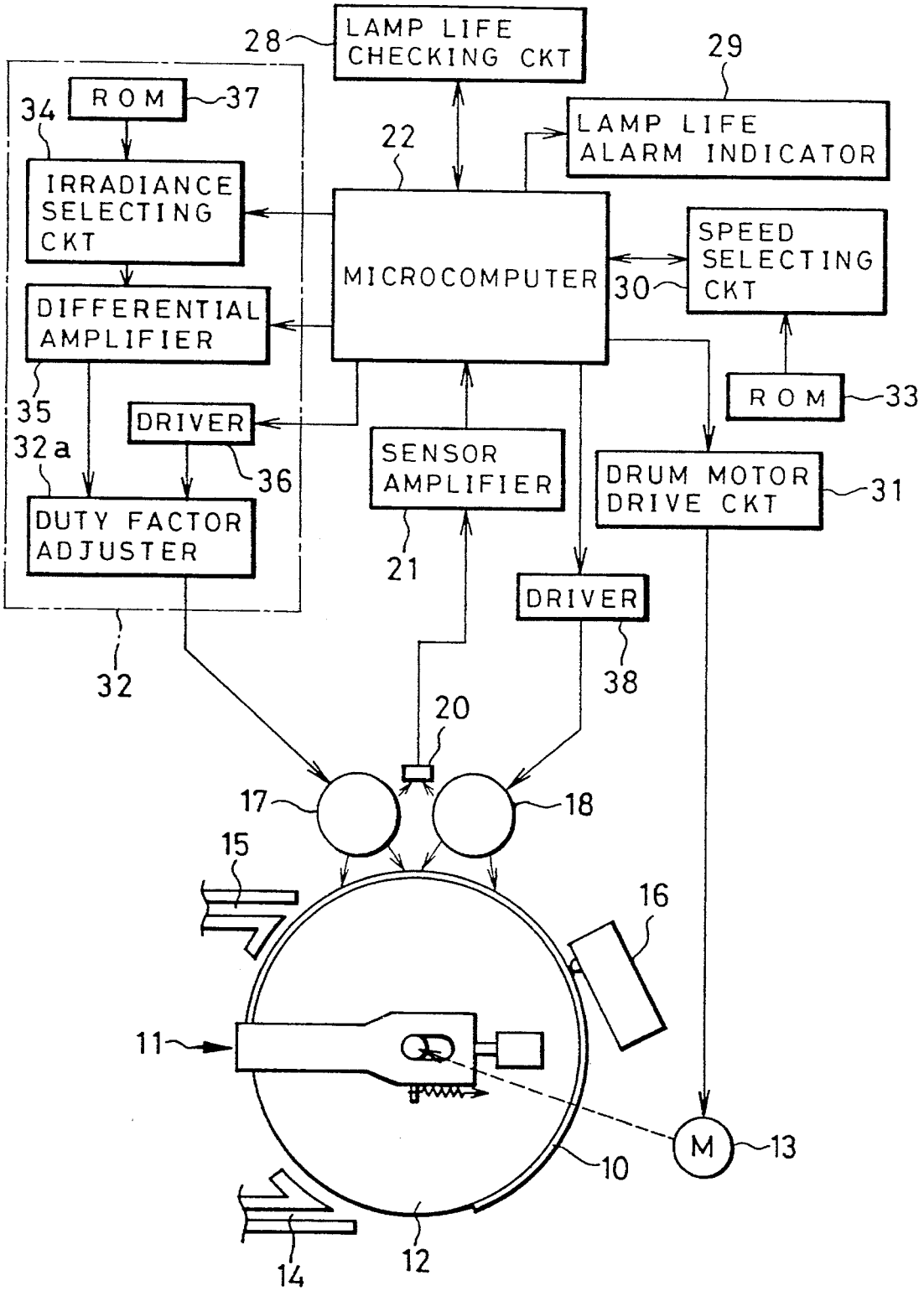
FIG. 1 is a schematic diagram illustrating a color thermal printer of the present invention.

FIG. 1 schematically illustrates a color thermal printer of the present invention. A color thermosensitive recording sheet 10 is mounted on the periphery of a platen drum 12. A clamp member 11 fixes an advancing edge of the recording sheet 10 on the platen drum 12. The clamp 11 is formed of transparent plastics. When images are thermally recorded or when the recording sheet 10 is fixed optically, the platen drum 12 is rotated by a motor 13. A plurality of recording sheets 10 are lapped together and contained in a cassette (not shown). The uppermost one of the plural recording sheets is fed through a feeding slot 14 to the platen drum 12. When all the processes of the printing are terminated, the recording sheet 10 is exited through an exit slot 15 toward a receptacle tray (not shown).

The periphery of the platen drum 12 is provided with a thermal head 16 in a recording position, and two ultraviolet lamps 17 and 18 in a tubular shape located downward from the thermal head 16. The thermal head 16, as known in the art, consists of a great number of heating elements arranged as an array, each of which generates thermal energy determined for colors and density to be recorded.

The yellow fixing lamp 17 or Y lamp emanates ultraviolet rays peaking at a wavelength of approximately 420 nm in the radiating distribution. The magenta fixing lamp 18 or M lamp emanates ultraviolet rays peaking at a wavelength of approximately 365 nm. The yellow fixing lamp 17 also emanates ultraviolet rays at a wavelength of 365 nm to a small extent. The magenta fixing lamp 18 emanates ultraviolet rays at a wavelength of 420 nm to a small extent. Inside each tube of the lamps 17 and 18, a reflective layer is formed to cover the tube, except for a sector-like range at an angle of 90 degrees to confront the platen drum 12.

The reflective layer of the lamps 17 and 18 is translucent to a small extent, and transmits a small amount of fixing ultraviolet rays therethrough. A sensor 20 detects the fixing rays passed through the reflective layer, to measure irradiance of the radiating brightness or the irradiance at the recording sheet 10. The output signal of the sensor 20 is converted by a sensor amplifier 21 into voltage, and entered in a microcomputer 22. The ray measurement is slightly after the thermal recording. Alternatively, it is possible to measure the rays slightly before the thermal recording.

Figure 2:
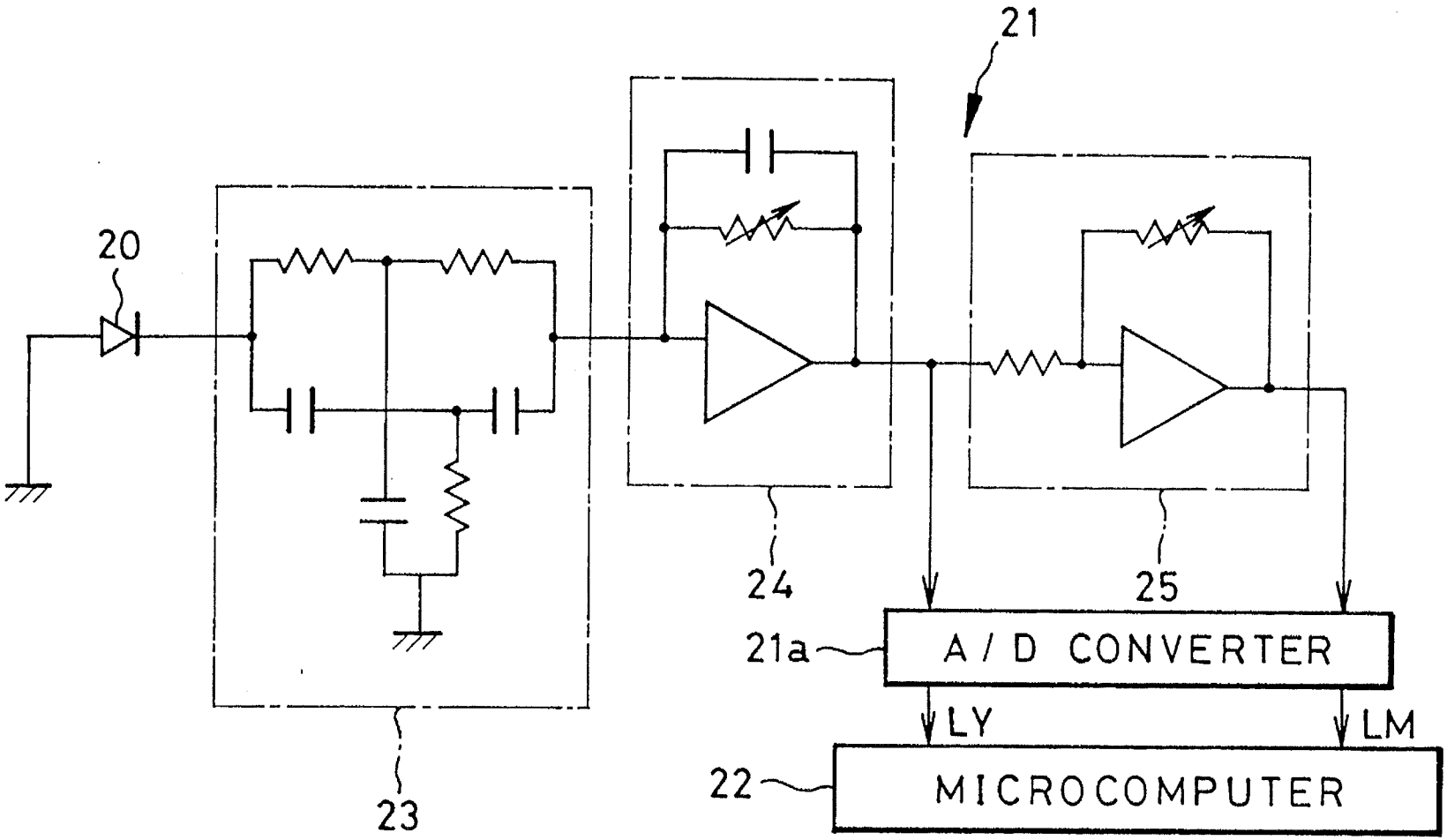
FIG. 2 is a schematic diagram structurally illustrating a sensor amplifier.

The sensor amplifier 21, as illustrated in FIG. 2, consists of a filter circuit (twin T circuit) 23, two serially connected amplifying circuits 24 and 25, and an A/D converter 21*a*. The filter circuit 23 cuts off a component of frequency not higher than 488 Hz from input signals. The upstream amplifying circuit 24 cuts off a component of frequency not lower than 50 kHz from input signals, and at the same time converts a current value to a voltage value. From the sensor amplifier 21, the output of the upstream amplifying circuit 24 is used for measuring the ultraviolet irradiance emanated from the yellow fixing lamp 17. The output of the downstream amplifying circuit 25 is used for measuring the ultraviolet irradiance emanated from the magenta fixing lamp 18. Those outputs are sent to the microcomputer 22.

To the microcomputer 22 are connected a lamp life checking circuit 28, a lamp life alarm indicator 29, a speed selecting circuit 30, a drum motor drive circuit 31, and a lamp irradiance adjusting section 32. The checking circuit 28 has preset values LSY and LSM of irradiance, and compares them with irradiances LY and LM of the lamps 17 and 18 as measured at the sensor 20. If the irradiance LY is lower than the preset irradiance LSY, or if the irradiance LM is lower than the preset irradiance LSM, then the checking circuit 28 sends "Low" signal to the microcomputer 22. If the irradiance LY is higher than the preset irradiance LSY, or if the irradiance LM is higher than the preset irradiance LSM, then the checking circuit 28 sends "High" signal to the microcomputer 22. The microcomputer 22 measures time. If the microcomputer 22 does not receive any High signal from the checking circuit 28 before a lapse of a predetermined length of time, then the microcomputer 22 causes the alarm indicator 29 for indicate alarm, either in visual fashion with a lamp, or in audible fashion with a buzzer. It is to be noted that the preset irradiances LSY and LSM are substantially the smallest values enough for optical fixation of the recording sheet 10.

It is preferable to define the preset irradiances LSY and LSM at 70% of the maximum irradiances of the lamps 17 and 18. To be precise, the preset irradiance LSY for the yellow fixing lamp 17 is 58.8 mW. The preset irradiance LSM for the magenta fixing lamp 18 is 37 mW.

The speed selecting circuit 30 sets speeds of 1st rotations of the platen drum 12 in accordance with each heat sensitivity of coloring layers 41 to 43, and selects speeds of 2nd rotations in accordance with the irradiance measured at the sensor 20. A signal representing each speed is sent to the microcomputer 22. The drum motor drive circuit 31 controls the motor 13 by adjusting the voltage or current across it in accordance with a speed signal from the microcomputer 22, and adjusts the speed of the platen drum 12. ROM 33 stores table data representing a relationship between the speed of the platen drum 12 and the irradiance measured at the sensor 20.

The adjusting section 32 is constituted by an irradiance selecting circuit 34, a differential amplifier 35, a lamp driver 36, a duty factor adjuster 32*a*, and a ROM 37. The selecting circuit 34 selects one of plural preset values of target irradiance in accordance with the irradiance measured at the sensor 20. The differential amplifier 35 calculates a difference between the measured irradiance and the target irradiance selected by the selecting circuit 34, and sends a signal of the difference to the duty factor adjuster 32*a*.

The duty factor adjuster 32*a* adjusts the duty factor of drive signals supplied by the driver 36 for the yellow fixing lamp 17 in accordance with the difference signal. An alternate current of 30 kHz is generated by the driver 36. When the yellow fixing lamp 17 is connected directly to the driver 36, the duty factor of the drive signal is 100%. For example, every N cycles of the alternate current, let the duty factor adjuster 32*a* cut (N−n) cycles away from the current while allowing n cycles to pass. Then the duty factor of the drive signal is n/N. If 15 cycles among 30 cycles are cut away, then the duty factor is 50%, as 15 cycles are passed. If 10 cycles among 30 cycles are cut away, then the duty factor is 66.7% as 20 cycles are passed. Note that it is alternatively possible to use drive pulses of a high frequency to drive the ultraviolet lamp, as the time of the on-state of the pulses can be changed to adjust the duty factor.

ROM 37 stores table data representing the plural target irradiances and the measured irradiance at the sensor 20. Those functions are executed by means of software within the microcomputer 22. It is noted that the magenta fixing lamp 18 is supplied with the alternate current of 30 kHz by a driver 38, and generates stably unchanged irradiance at the duty factor of 100%.

Figure 3:
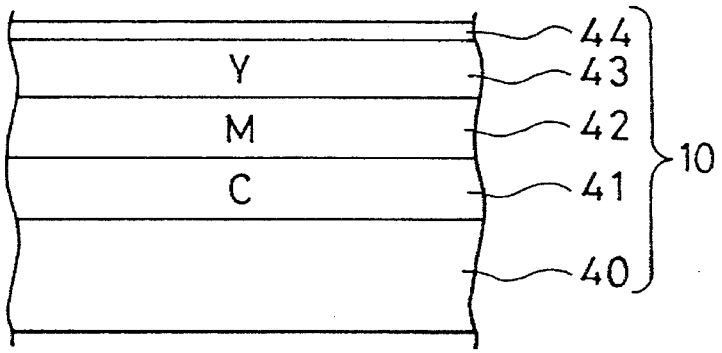
FIG. 3 is an explanatory view illustrating a layered structure of color thermosensitive recording sheet.

FIG. 3 illustrates the color thermosensitive recording sheet 10. On a support 40 are formed a cyan (C) thermosensitive coloring layer 41, a magenta (M) thermosensitive coloring layer 42, a yellow (Y) thermosensitive coloring layer 43, and a protective layer 44 in the order listed. The arrangement of the coloring layers 43 down to 41, from the obverse toward the reverse of the recording sheet 10, is the same as the order of being processed by the heat applied for the recording. Note that, if a different recording sheet has an arrangement of magenta, yellow and cyan coloring layers toward the support, the order of the thermal recording is determined to follow this arrangement. As is not illustrated, respective intermediate layers are formed between every two adjacent coloring layers.

The cyan coloring layer 41 includes as its main components an electron-donor type dye precursor and an electronacceptor type compound, and forms a cyan dye when heated. The magenta coloring layer 42 includes a diazonium salt compound having a maximum absorption wavelength of approximately 365 nm, and a coupler which forms a magenta dye when it is thermally reacted with the diazonium salt compound. When fixing ultraviolet rays of about 365 nm are applied to the magenta coloring layer 42 after thermal recording, the diazonium salt compound is discomposed photochemically and loses the coloring ability. The yellow coloring layer 43 includes a diazonium salt compound having a maximum absorption wavelength of approximately 420 nm, and a coupler which forms a yellow dye when it is thermally reacted with the diazonium salt compound. When fixing rays of about 420 nm are applied to the yellow coloring layer 43, it is discomposed photochemically and loses the coloring capacity. Heat energy required for the thermal head 16 to develop colors in the recording sheet 10 is different between the coloring layers 41 to 43: the highest energy is required for coloring of the yellow coloring layer 43; the lowest energy is required for coloring the cyan coloring layer 41.

Figure 4:
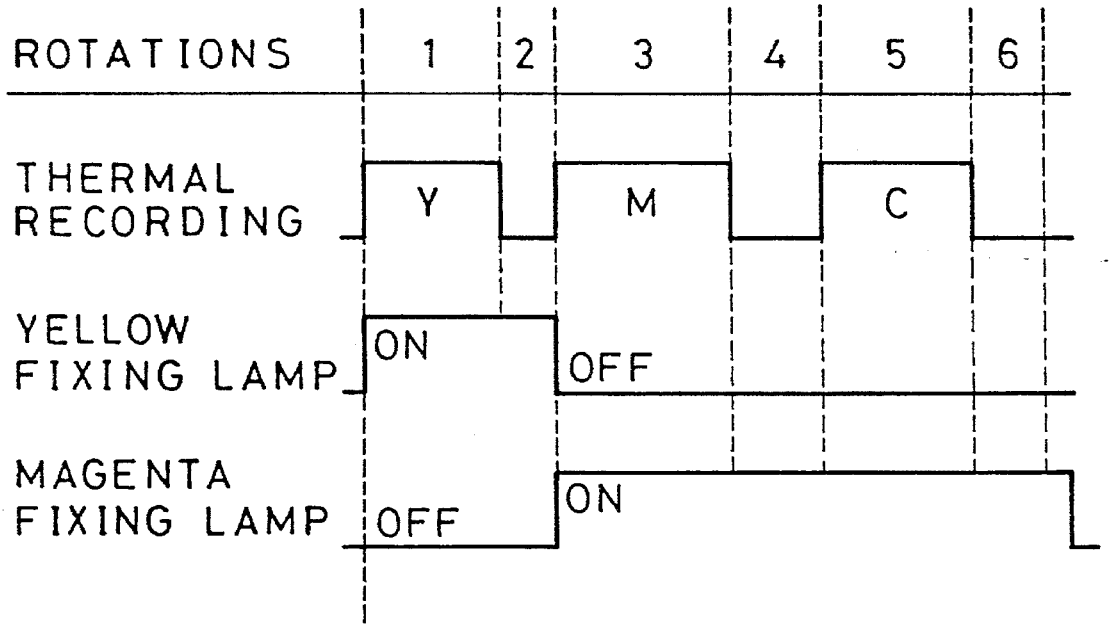
FIG. 4 is a timing chart illustrating relationships between rotation of a platen drum, thermal recording, and optical fixation.

In a timing chart of FIG. 4, rotations of the platen drum 12 are associated with the thermal recording and the optical fixation. For the thermal recording to each one of the coloring layers 41 to 43, two rotations are made by the platen drum 12. A 1st rotation of the two is made for the thermal recording and an initial fixation. The 2nd rotation is made only for a supplementary fixation. If the initial fixation is sufficient for fixing one coloring layer, no 2nd rotation is made for the same coloring layer. The yellow fixing lamp 17 is turned on during the recording of the yellow coloring layer 43. The magenta fixing lamp 18 is turned on during the recording of the magenta and cyan coloring layers 42 and 41.

FIGS. 5A to 5C illustrate table data which are stored in ROM 33, and represent relationships between a rotating speed of the platen drum 12 and the irradiances measured at the sensor 20. The table data in FIG. 5A is used for the recording to the yellow coloring layer 43; the table data in FIG. 5B for the recording to the magenta coloring layer 42; the table data in FIG. 5C for the recording to the cyan coloring layer 41. The table data in FIG. 5A contains a rotational speed SY1 for the 1st rotation, which is determined in accordance with the yellow coloring layer 43, and irrespective of the measured irradiance LY. In FIG. 5B, a speed SM1 for the 3rd rotation is determined in accordance with the magenta coloring layer 42, and irrespective of the measured irradiance LM. In FIG. 5C, a speed SC1 for the 5th rotation is determined in accordance with the cyan coloring layer 41, and irrespective of the measured irradiance LM.

Figures 6, 7:
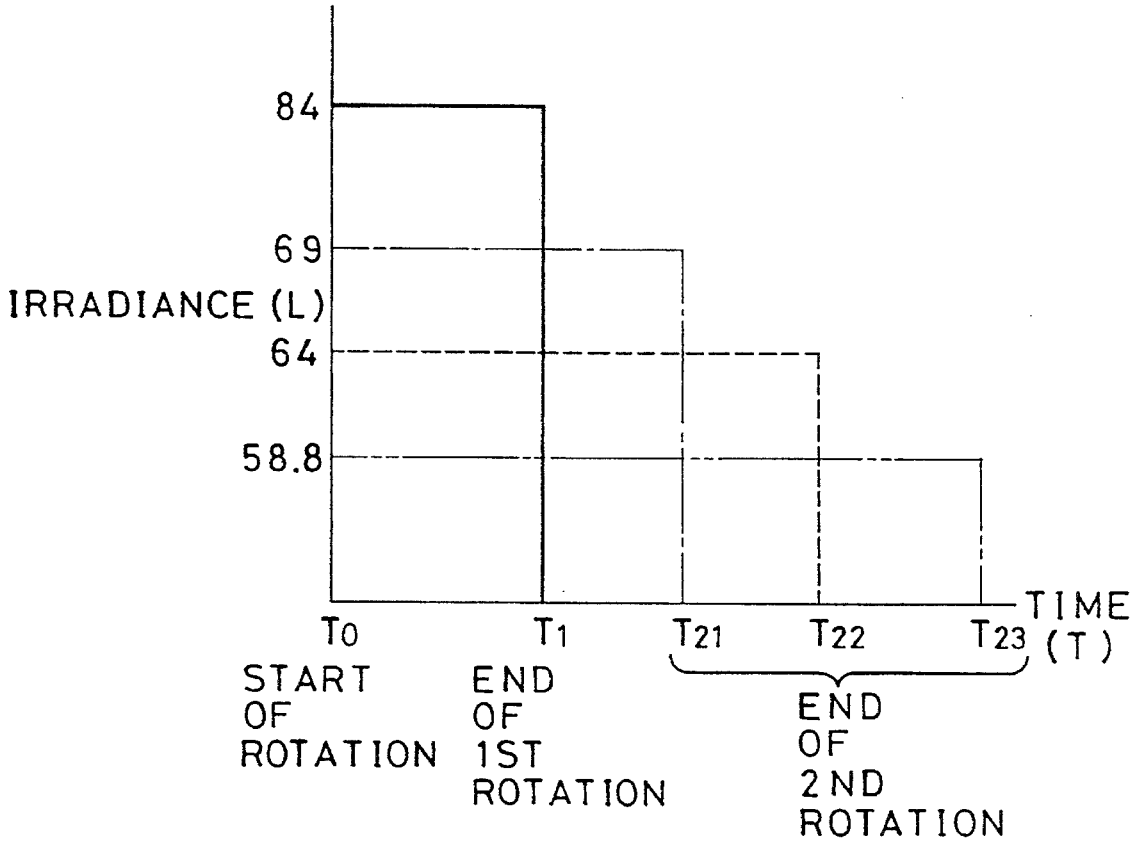
FIG. 6 is a table illustrating a relationship between a target irradiance and the measured irradiance of a yellow fixing lamp.
FIG. 7 is a graph illustrating a relationship between fixing time and the irradiance of the yellow fixing lamp.

FIG. 6 illustrates the table data, stored in ROM 37, for representing the relationship between the target irradiances and the measured irradiance of the yellow fixing lamp 17 at the sensor 20. The measured irradiance LS (in mW) of the yellow fixing lamp 17 and the rotational speeds SY1 and SY2 (in p.p.s. or pulses per second ) are so determined that a total amount LT of applied ultraviolet rays, defined per unit area on the recording sheet 10 (in $mW/cm^2$), is unchanged. To be precise, the total ray amount LT is defined as:

$$LT=1/SY1\times 84$$

$$=1/SY1\times LS+1/SY2\times LS.$$

In the equation, 1/SY1 and 1/SY2 represent time required for the respective 1st and 2nd rotations of the platen drum 12. If, as is illustrated in FIG. 7, the target irradiance LS is high, the speed for the 2nd rotation SY2 is set high to shorten the time of the ultraviolet application. If the target irradiance LS is low, the speed for the 2nd rotation SY2 is set low to lengthen the time of the ultraviolet application.

Figure 8:
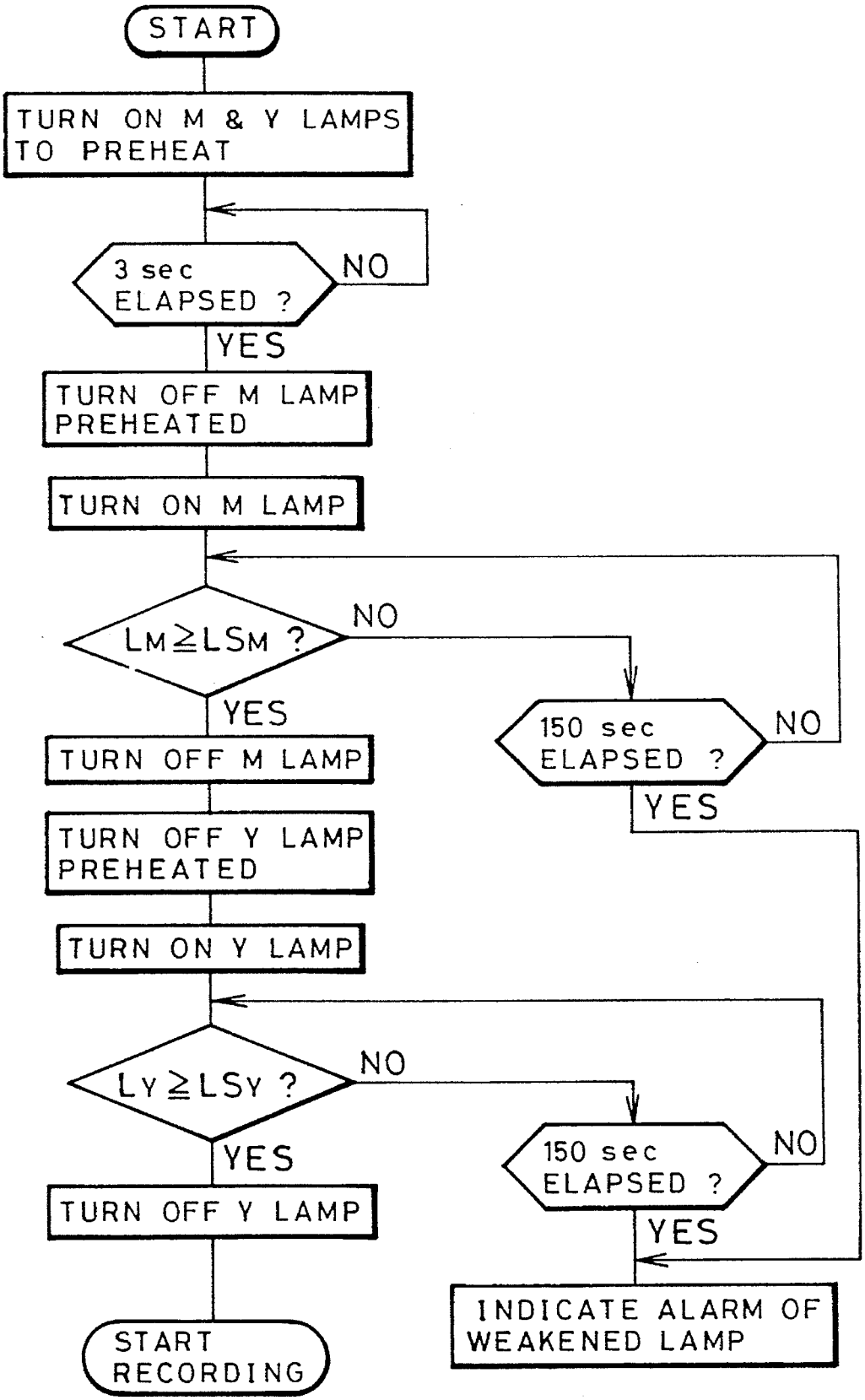
FIG. 8 is a flow chart illustrating a sequence preparatory to the printing.

The operation of the above embodiment is described now. When a print starting key is operated, the preheating operation preparatory to the recording is performed in accordance with FIG. 8. The lamps 17 and 18 are started being preheated at the same time. At the lapse of 3 seconds, only the magenta fixing lamp 18 is stopped from being preheated. The life or using condition of the magenta fixing lamp 18 is now checked. When the magenta fixing lamp 18 is turned on, responsively the sensor 20 starts detecting rays from the magenta fixing lamp 18. The sensor signal from the sensor 20 is converted into the voltage signal representing the irradiance LM. The voltage signal is sent into the microcomputer 22 and to the checking circuit 28.

The checking circuit 28 compares the irradiance LM measured at the sensor 20 with the target irradiance LSM as selected. If LM<LSM, the checking circuit 28 sends a "Low" signal to the microcomputer 22. If LM≧LSM, a "High" signal is sent. The magenta fixing lamp 18 is checked for 150 seconds. If the microcomputer 22 receives the High signal not later than the lapse of the 150 seconds, then it judges that the magenta fixing lamp 18 can emanate minimum rays sufficient for the fixation, and turns off the magenta fixing lamp 18 to terminate the checking of the lamp 18. If in turn the microcomputer 22 does not receive the High signal at the lapse of the 150 seconds from the checking circuit 28, then it judges that the magenta fixing lamp 18 cannot any longer emanate rays sufficient for the fixation, and indicate the alarm of the magenta fixing lamp 18 which appears weakened, while driving the alarm indicator 29 and terminating the preparatory operation of the preheating before the recording.

When the using condition of the magenta fixing lamp 18 is checked, the yellow fixing lamp 17 is stopped from being preheated. The using condition of the yellow fixing lamp 17 is checked. The checking operation is the same as that for the magenta fixing lamp 18. If there occurs abnormality or degradation, it is indicated as an alarm. If and only if there is no problem in actuation of the magenta fixing lamp 18, then the recording is started.

Figure 9A:
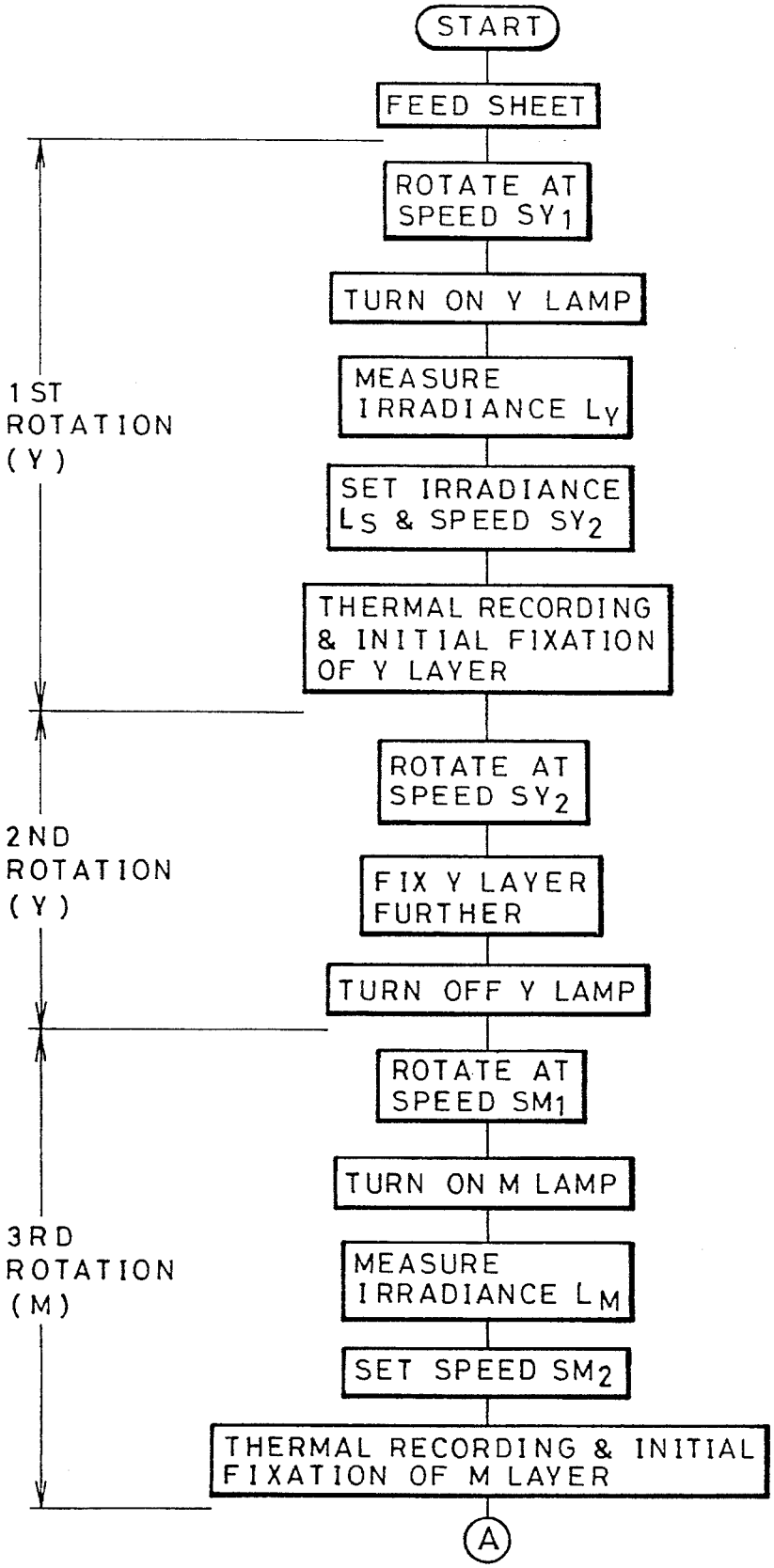
FIGS. 9A and 9B are flow charts illustrating a sequence of the printing on the recording sheet.
Figure 9B:
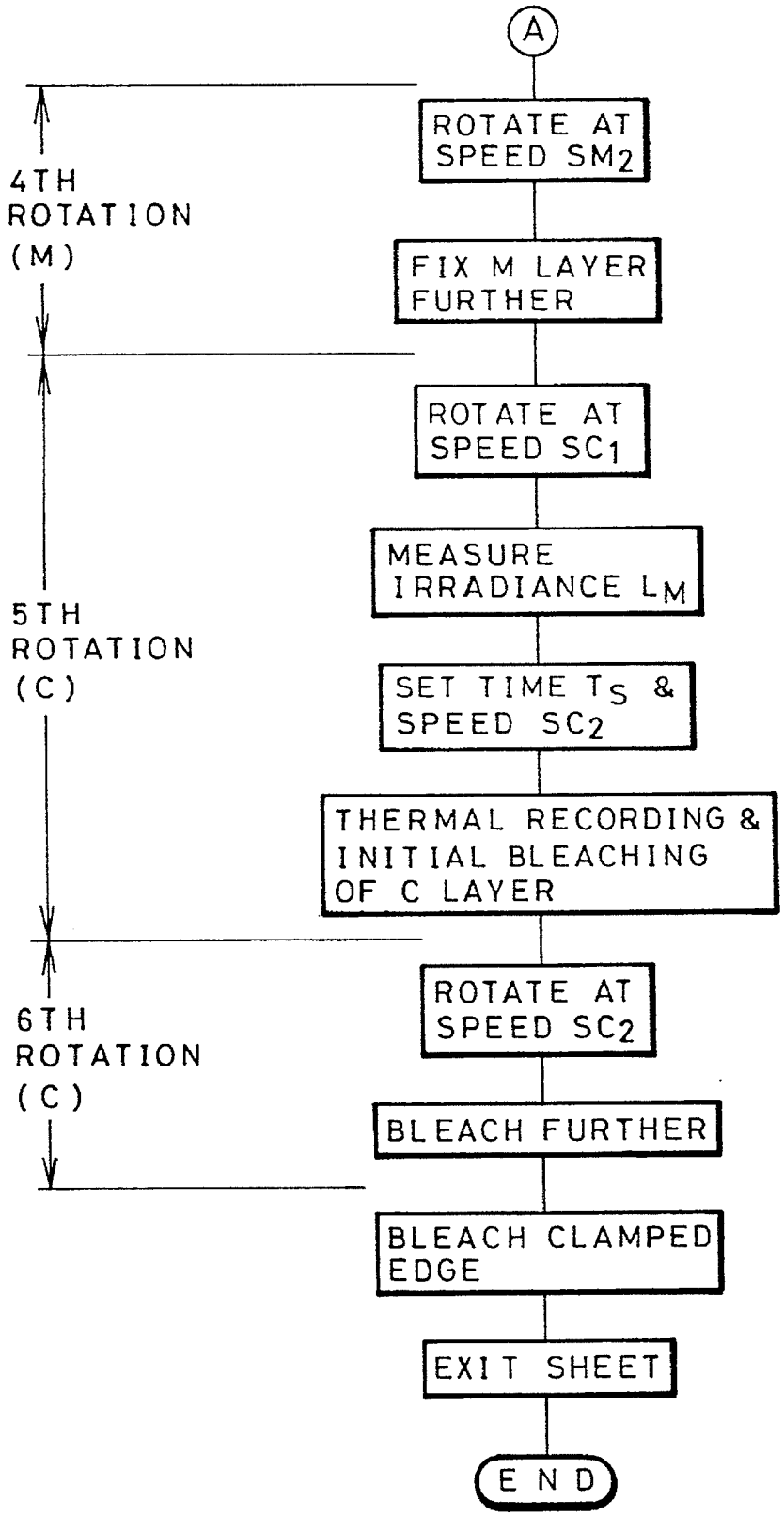

The recording is executed as illustrated in FIGS. 9A and 9B. The recording sheet 10 is fed from the cassette (not shown) and conveyed to the platen drum 12. The recording sheet 10 is set in the clamping position on the platen drum 12. The clamp 11 fixes the advancing edge of the recording sheet 10 on the platen drum 12. Then the motor 13 rotates to rotate the platen drum 12, and winds the recording sheet 10 on the platen drum 12.

With the recording sheet 10 fed, the microcomputer 22 reads the speed SY1, e.g. 336 p.p.s. from ROM 33 for the recording of the yellow image, and causes the drum motor drive circuit 31 to rotate the platen drum 12. At the same time the yellow fixing lamp 17 is actuated. The fixing rays from the yellow fixing lamp 17 are detected by the sensor 20, converted into the irradiance LY by the sensor amplifier 21, and sent to the microcomputer 22.

The microcomputer 22 obtains the measured irradiance LY and sends it to the speed selecting circuit 30 and the irradiance selecting circuit 34. The speed selecting circuit 30 refers to the table data written in ROM 33 for the yellow, and determines the speed SY2 of the platen drum 12 in accordance with the irradiance LY for the supplementary fixation. The irradiance selecting circuit 34 refers to the table data written in ROM 37, and determines the target irradiance LS in accordance with the measured irradiance LY.

When the speed SY2 and the target irradiance LS are determined, the yellow image is started being recorded to the yellow coloring layer 43. At the same time, the fixing rays from the yellow lamp 17 are detected by the sensor 20, converted into the irradiance LY, and sent to the microcomputer 22 and into the differential amplifier 35, which calculates the difference between the irradiance LY and the target irradiance LS from the irradiance selecting circuit 34. The difference signal is sent to the duty factor adjuster 32*a*.

The duty factor adjuster 32*a* responds to the difference signal, and adjusts the duty factor of the drive signals supplied to the yellow fixing lamp 17. If an excessive amount of the ultraviolet rays are emanated from the yellow fixing lamp 17, then the duty factor adjuster 32*a* lowers the duty factor to reduce the rays to be emanated. In consequence, the irradiance LY of the rays emanated from the yellow fixing lamp 17 is changed to be the target irradiance LS.

In course of the rotation of the platen drum 12, an advancing edge of the recording sheet 10 comes up to thermal head 16, which starts thermally recording the yellow image to the yellow coloring layer 43 line after line. In the thermal recording of the yellow image, each of the heating elements generates thermal energy associated with the coloring density. In the further rotation, a portion where the yellow image is recorded comes to the yellow fixing lamp 17, at which the yellow coloring layer 43 is fixed optically. As the yellow fixing lamp 17 emanates fixing ultraviolet rays of approximately 420 nm, the diazonium salt compound in the yellow coloring layer 43 is photochemically decomposed to destroy the coloring ability. The duty factor adjuster 32*a* controls the passage of the 30 kHz alternate current in intermittent fashion, and adjusts the duty factor of the current with which the lamp driver 36 supplies the yellow fixing lamp 17. The radiating intensity of the yellow fixing lamp 17 is therefore kept constant. The entirety of the recording sheet 10 is fixed optically in regular fashion. When a trailing end of the recording sheet 10 is passed off from the thermal head 16, the thermal head 16 is turned off.

To start the 2nd rotation, the microcomputer 22 causes the platen drum 12 to rotate at the speed SY2 determined by the selecting circuit 30. The recording sheet 10, with the yellow image recorded, is supplied with ultraviolet application at the wavelength 420 nm at the yellow fixing lamp 17. If a greater amount of ultraviolet rays have been applied in the 1st rotation, then the speed SY2 of the platen drum 12 is set the higher to shorten the time of ultraviolet application to the recording sheet 10. If in turn a smaller amount of ultraviolet rays have been applied in the 1st rotation, then the speed SY2 of the platen drum 12 is set the lower to lengthen the time of ultraviolet application to the recording sheet 10. In due course the trailing end of the recording sheet 10 is passed under the yellow fixing lamp 17, so as to turn off the lamp 17.

The fixing ultraviolet rays having the wavelength of 425 nm decompose the magenta coloring layer 32 to a small extent. Should the yellow coloring layer 43 be fixed to a greater extent, the fixing rays would fix the magenta coloring layer 42 to a small extent, so as to lower the coloring sensitivity of the magenta coloring layer 42. In consequence, it is desirable to control the radiating intensity of the yellow fixing lamp 17, so as to avoid unwanted excess or shortage in the fixing rays.

Then the magenta image is started to be recorded. The microcomputer 22 reads the speed SM1, for example 205 p.p.s., from ROM 33 for the thermal recording of the magenta, and causes the platen drum 12 to rotate at the same speed. Responsively the magenta fixing lamp 18 is turned on. The ultraviolet rays emanated from the magenta fixing lamp 18 is detected by the sensor 20, converted into the irradiance LM, and sent to the microcomputer 22 and into the speed selecting circuit 30, which refers to the magenta table data written in ROM 33, and determines the speed SM2 in accordance with the measured irradiance LM.

In the course of rotation of the platen drum 12, the advancing edge of the recording area on the recording sheet 10 comes to the thermal head 16 for a third time. The thermal head 16 thermally records a magenta image on the magenta coloring layer 42 line after line. In the recording of the magenta image, each heating element of the thermal head 16 generates energy determined according to the coloring density. After the magenta image is thermally recorded on the recording sheet 10, the fixing rays are applied to the recording sheet 10 by the magenta fixing lamp 18. The magenta fixing lamp 18 emanates fixing ultraviolet rays of approximately 365 nm. The magenta fixing lamp 18 emanates fixing rays at the unchanged maximum intensity while supplied with the 30 kHz alternate current. The diazonium salt compound in the magenta coloring layer 42 is photochemically decomposed to destroy the magenta coloring ability in the entirety of the recording sheet 10. When the trailing end of the recording sheet 10 is passed off from the thermal head 16, the thermal head 16 is turned off.

The microcomputer 22 causes the platen drum 12 to rotate at the speed SM2 determined by the selecting circuit 30. This is the 4th rotation of the platen drum 12. With the magenta image recorded, the recording sheet 10 is further supplied with ultraviolet application of the wavelength 365 nm under the magenta fixing lamp 18. The magenta coloring layer 42 has received sufficient rays and completely fixed. The coloring ability of the same layer 42 is destroyed.

Figures 10, 11:
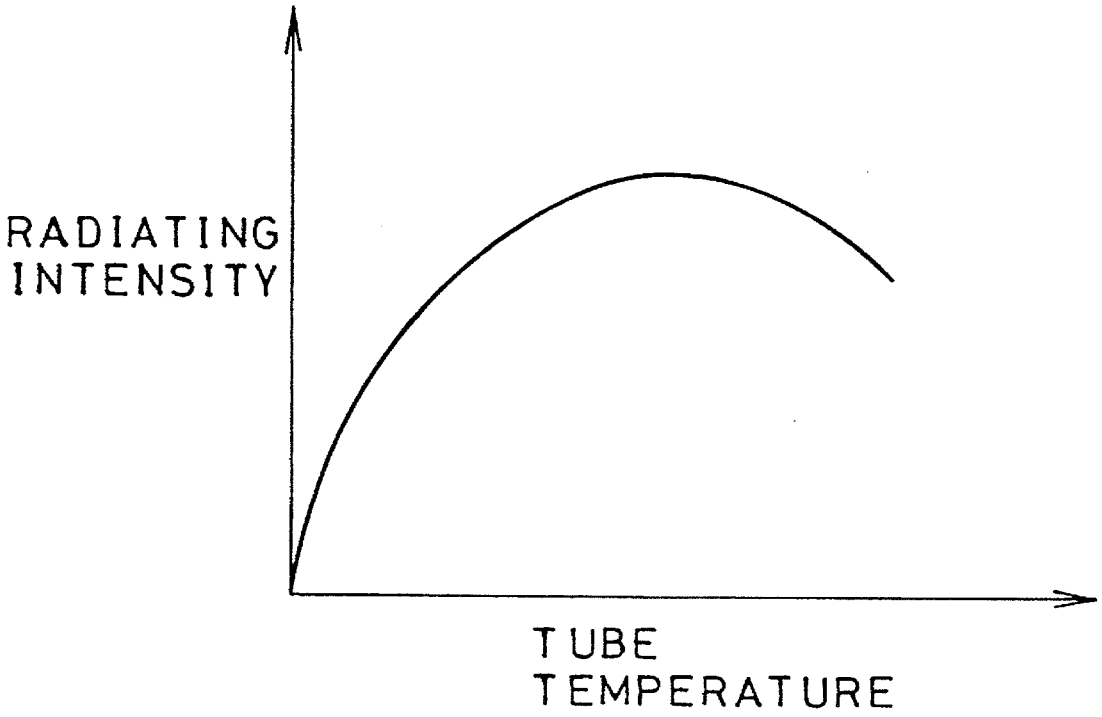
FIG. 10 is a table illustrating a relationship between the measured irradiance and time for bleaching clamped edge.
FIG. 11 is a graph illustrating a relationship between a radiating intensity and tube temperature of the fixing ultraviolet lamps.

To record a cyan image on the cyan coloring layer 41, the platen drum 12 rotates for a third time and at the speed SC1. The fixing rays from the magenta fixing lamp 18 are detected by the sensor 20 again, and measured to obtain the irradiance LM for the second time. The speed SC2 for the 6th rotation of the platen drum 12 is determined in accordance with the irradiance LM. Note that the last measured LM can be different from the previously measured LM because the temperature on the same lamp 18 may change to influence the irradiance, as illustrated in FIG. 11. The speed SC2 is adjusted by the last measured LM.

The platen drum 12 rotates at the speed SC1 until the advancing edge of the recording sheet 10 reaches the thermal head 16, which thermally records a cyan image on the cyan coloring layer 41 line after line. The coloring of the cyan coloring layer 41 requires high coloring heat energy of at least as much as 80 $mJ/mm^2$, which does not allow developing color in an ordinary condition of preserving the recording sheet 10. The cyan coloring layer 41 lacks a characteristic of photochemical fixability. However the magenta fixing lamp 18 remains actuated.

The fixation of the magenta coloring layer 42 requires application of the considerable fixing rays. Such further application of the fixing rays to the magenta coloring layer 42 could be caused by making slower and longer the 4th rotation of the platen drum 12. However, this would slow down the recording operation and be a shortcoming inconsistent to the high performance of the printer. In consequence, the magenta fixing lamp 18 is kept actuated also during the recording of the cyan image, for a supplement of the fixing rays.

The microcomputer 22 causes the platen drum 12 to rotate at the speed SC2. This is the 6th rotation of the platen drum 12. With the cyan image recorded, the recording sheet 10 is further supplied with the same ultraviolet application under the magenta fixing lamp 18. The yellow coloring layer 43 receives the rays to be bleached. Even though the yellow coloring layer 43 has been discolored by the coloring of the cyan coloring layer 42, the discoloration is eliminated by the bleaching with the ultraviolet rays.

At the end of the 6th rotation of the platen drum 12, the clamp 11 passes under the thermal head 16. Responsively the platen drum 12 is stopped. The clamp 11 is moved up and unlatched from the recording sheet 10. Then the platen drum 12 is rotated again. The recording sheet 10 is pressed under the thermal head 16, and thus is rotated together with the platen drum 12. The advancing edge of the recording sheet 10 having been clamped comes under the magenta fixing lamp 18. Then the platen drum 12 is stopped from rotating. The advancing edge having been clamped is now bleached and optically fixed by the magenta fixing lamp 18. The time TS for this operation of bleaching and fixation is selected from plural values stored in ROM 33, and is determined in accordance with the finally measured irradiance LM. At the lapse of the time TS, the magenta fixing lamp 18 is turned off.

Then the platen drum 12 is rotated again. The advancing edge of the recording sheet 10 is inserted into the exit slot 15, and exited to a receptacle tray (not shown).

As illustrated in FIG. 11, each ultraviolet lamp 17, 18 has a characteristic in which the intensity of emanating the rays is changed according as its tube temperature is changed. In the range of low and middle temperature, the ultraviolet intensity increases according to the rise of the temperature. In the range of middle and high temperature, the intensity in turn decreases according to the rise of the temperature. In the present invention, the irradiance LY, LM is checked just at the beginning of the lamp actuation, so that the speed for the fixation is controlled, effectively to eliminate the influence of the change in the temperature. In a conventional thermal printer without such an operation, a serious problem would remain in that the temperatures would affect the image on the recording sheet neatly to be fixed.

In the above embodiment, the recording sheet 10 is mounted on the periphery of the platen drum 12 to move. Alternatively, a reciprocating slide plate may be used for supporting the recording sheet 10 to move it reciprocally. Further, it is preferable to use a fan for cooling the magenta fixing lamp 18 to avoid overheating the magenta fixing lamp 18, desirably in automated fashion in response to the rise of the tube temperature of the lamp 18 to come over a predetermined value. As is described with the prior art, ultraviolet lamps have such a characteristic that excessively high tube temperature lowers the radiating intensity. The use of the fan is preferable because the magenta fixing lamp 18 is constantly driven at the maximum intensity.

In the above, the duty factor adjuster 32*a* only lowers the duty factor to reduce the rays to be emanated, when an excessive amount of the ultraviolet rays are emanated from the yellow fixing lamp 17. Furthermore, a different duty factor adjuster may also raise the duty factor to intensify the rays to be emanated from the yellow fixing lamp 17, responsively if there may be shortage in the emanated ultraviolet rays as compared with a selected target irradiance. In consequence, the irradiance LY of the rays emanated from the yellow fixing lamp 17 can also be changed to be the target irradiance LS.

In the above, the rotating speeds meet $SY1<SY2<SM1<SM2$ and $SC1<SC2$. This is favorable in that the 2nd, 4th and 6th rotations are sufficiently fast to shorten the rotating time for the supplementary ultraviolet rays. However, it is possible to set rotating speeds to meet $SY1 \geqq SY2 \geqq SM1 \geqq SM2$ and $SC1 \geqq SC2$.

In the above, the thermal head 16 is stationary. The recording sheet 10 is rotated by the platen drum 12. Alternatively, a thermal head may be mounted to be movable. The recording sheet 10 may be stationary.

In the above, the speeds and target irradiance are selected from the values stored in ROMs 33 and 37. Alternatively, speeds and irradiances may be calculated from the measured irradiances and by use of equations which may be stored in ROMs.

In the above, the single sensor 20 is used for detecting the ultraviolet rays from the two lamps 17 and 18. Alternatively two sensors may be individually associated with the two lamps 17 and 18.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A color thermal printer for use with color thermosensitive recording material including a support and first to third thermosensitive coloring layers formed thereon, said first to third coloring layers arranged toward said support from an obverse of said recording material, said thermal printer including a moving device for relative movement of said recording material and a thermal head relative to one another, said relative movement subjecting said first to third coloring layers to thermal recording sequentially in an order listed, and wherein a first ultraviolet lamp is actuated for optical fixation of said first coloring layer after said thermal recording, and a second ultraviolet lamp is actuated for optical fixation of said second coloring layer after said thermal recording, said color thermal printer comprising:

a measuring device for measuring a first irradiance of said first lamp while actuated by a first drive signal set at a duty factor, and for measuring a second irradiance of said second lamp while actuated by a second drive signal set at a duty factor;

an irradiance determining device for determining a target irradiance in accordance with said first irradiance;

a first lamp driver for driving said first lamp with said first drive signal, said first lamp driver connected to said irradiance determining device, for redetermining said duty factor of said first drive signal in accordance with said first irradiance and said target irradiance, to maintain said target irradiance at which said first lamp is actuated;

a second lamp driver for driving said second lamp with said second drive signal with said duty factor unchanged, to maintain said second irradiance at which said second lamp is actuated;

a speed determining device for determining a first relative speed in accordance with heat sensitivity of said first coloring layer, a second relative speed in accordance with said first irradiance, a third relative speed in accordance with heat sensitivity of said second coloring layer, and a fourth relative speed in accordance with said second irradiance; and a control device for driving said moving device, and for controlling said first and second lamp drivers, said control device causing said first lamp to maintain said target irradiance in said thermal recording to said first coloring layer, and causing said relative movement of said moving device at said first speed, subsequently said control device causing said relative movement of said moving device at said second speed, for supplementary fixation of said first coloring layer with said first lamp, subsequently said control device causing said second lamp to maintain said second irradiance in said thermal recording to said second coloring layer, and causing said relative movement of said moving device at said third speed, and subsequently said control device causing said relative movement of said moving device at said fourth speed, for supplementary fixation of said second coloring layer with said second lamp.

2. A color thermal printer as defined in claim 1, wherein said first drive signal comprises an alternate current having a regular period, and said first lamp driver passes n cycles among generated N cycles while cutting away (N–n ) of said N cycles to redetermine said duty factor as n/N.

3. A color thermal printer as defined in claim 2, wherein:

said speed determining device compares said first irradiance with a first preset upper limit, and if said first irradiance is equal to or more than said first preset upper limit, then said moving device disabled from causing said relative movement at said second speed, without said supplementary fixation of said first coloring layer; and said speed determining device compares said second irradiance with a second preset upper limit, and if said second irradiance is equal to or more than said second preset upper limit, then said moving device disabled from causing said relative movement at said fourth speed, without said supplementary fixation of said second coloring layer.

4. A color thermal printer as defined in claim 3, wherein said second speed is greater than said first speed, and said fourth speed is greater than said third speed.

5. A color thermal printer as defined in claim 4, wherein:

said second lamp is further actuated for said third coloring layer in said thermal recording;

said control device causing said relative movement of said moving device at a fifth relative speed with said second irradiance maintained, for said thermal recording to said third coloring layer through said thermal head;

said speed determining device determines a sixth relative speed in accordance with said second irradiance; and said control device causes said relative movement of said moving device at said sixth speed, for bleaching said third coloring layer with said second lamp after said thermal recording.

6. A color thermal printer as defined in claim 5, wherein said moving device is a platen drum which supports said recording material and rotates in a single direction, and is set at said first to sixth speeds for first to sixth rotations.

7. A color thermal printer as defined in claim 6, wherein said speed determining device further compares said second irradiance with a third preset upper limit, and if said second irradiance is equal to or more than said third preset upper limit, then said control device disabled from causing said relative movement at said sixth speed, without bleaching said recording material.

8. A color thermal printer as defined in claim 4, wherein said irradiance determining device includes:

an irradiance table memory for storing table data representing a relationship between said first irradiance and plural values of said target irradiance; and an irradiance selecting circuit, supplied with a signal of said first irradiance, for referring to said irradiance table memory, to select said target irradiance from among said plural values.

9. A color thermal printer as defined in claim 8, wherein said speed determining device includes:

a speed table memory for storing table data representing association of plural values of said second speed with said plural values of said target irradiance; and a speed selecting circuit, supplied with a signal of said target irradiance, for referring to said speed table memory, to designate said second speed from among said plural values.

10. A color thermal printer as defined in claim 9, wherein said irradiance table memory further stores table data representing a relationship between said second irradiance and plural values of said fourth speed, and said irradiance selecting circuit is further supplied with a signal of said second irradiance, and selects said fourth speed from among said plural values.

11. A color thermal printer as defined in claim 10, wherein said speed table memory further stores table data representing a relationship between said second irradiance and plural values of said sixth speed, and said speed selecting circuit further selects said sixth speed from among said plural values.

12. A color thermal printer as defined in claim 5, wherein said target irradiance is determined equal to or less than said first irradiance, and said first lamp driver redetermines said duty factor as equal to or less than a duty factor of said first drive signal in measurement of said first irradiance.

13. A color thermal printer as defined in claim 12, wherein said speed determining device determines said second speed higher when said target irradiance is determined higher, and determines said fourth speed higher when said second irradiance is measured higher.

14. A color thermal printer as defined in claim 13, wherein said speed determining device determines said sixth speed higher when said second irradiance is measured higher.

15. A color thermal printer as defined in claim 2, further comprising a comparing circuit for comparing said first and/or second irradiance with a preset lower limit, to detect degradation of said first and/or second lamp;

wherein said control device measures time, checks a signal from said comparing circuit, and if said first and/or second irradiance remains equal to or less than said preset lower limit at a lapse of predetermined time, then said control device disables said thermal recording.

16. A color thermal printer as defined in claim 15, further comprising an indicator, driven by said control device, for signaling information externally, and if said first and/or second irradiance remains equal to or less than said preset lower limit at a lapse of predetermined time, said indicator signaling said degradation of said first and/or second lamp.

17. A color thermal printer as defined in claim 2, wherein said measuring device includes:

a sensor for detecting ultraviolet rays from said first and second lamps; and an amplifier, connected to said sensor, for amplifying a signal from said sensor to obtain signals of said first and/or second irradiance.

18. A color thermal printer as defined in claim 17, further comprising a differential amplifying device for generating a signal of a difference between said target irradiance and said first irradiance, to supply said first lamp driver with said difference signal, said duty factor redetermined in accordance with said difference signal.

19. A color thermal printer as defined in claim 18, wherein said amplifier includes:

a first amplifying circuit, connected to said sensor, for amplifying said sensor signal; and a second amplifying circuit, connected downstream of said first amplifying circuit, for amplifying an output of said first amplifying circuit further;

wherein said control device is supplied with said output of said first amplifying circuit, to detect said first irradiance, and is supplied with an output of said second amplifying circuit, to detect said second irradiance.

20. A color thermal printer as defined in claim 19, further comprising a filter circuit, connected between said sensor and said first amplifying circuit, for cutting off a component of a wavelength smaller than a preset wavelength from said sensor signal;

wherein said first amplifying circuit further cuts off a component of a wavelength greater than a preset wavelength from a signal from said filter circuit.

21. A color thermal printing method for use with color thermosensitive recording material including a support and first to third thermosensitive coloring layers formed thereon, said first to third coloring layers arranged toward said support from an obverse of said recording material, relative movement caused between said recording material and a thermal head relative to one another, said relative movement subjecting said first to third coloring layers to thermal recording sequentially in an order listed, and wherein a first ultraviolet lamp is actuated for optical fixation of said first coloring layer after said thermal recording, and a second ultraviolet lamp is actuated for optical fixation of said second coloring layer after said thermal recording, said color thermal printing method comprising steps of:

measuring, with a sensor, a first irradiance of said first lamp while actuated by a drive signal set at a duty factor;

measuring, with said sensor, a second irradiance of said second lamp while actuated;

determining a target irradiance in accordance with said first irradiance;

redetermining said duty factor of said drive signal in accordance with said first irradiance and said target irradiance, said drive signal supplied to said first lamp, to actuate said first lamp at said target irradiance;

determining a first relative speed in accordance with heat sensitivity of said first coloring layer;

maintaining said first lamp at said target irradiance;

causing said relative movement of said recording material at said first speed, for said thermal recording to said first coloring layer through said thermal head, and for fixing said first coloring layer with said first lamp after said thermal recording;

determining a second relative speed in accordance with said first irradiance;

causing said relative movement of said recording material at said second speed, for supplementary fixation of said first coloring layer with said first lamp;

determining a third relative speed in accordance with heat sensitivity of said second coloring layer;

causing said relative movement of said recording material at said third speed, for said thermal recording to said second coloring layer through said thermal head, and for fixing said second coloring layer with said second lamp after said thermal recording;

determining a fourth relative speed in accordance with said second irradiance; and causing said relative movement of said recording material at said fourth speed, for supplementary fixation of said second coloring layer with said second lamp.

22. A color thermal printing method as defined in claim 21, wherein said drive signal comprises an alternate current having a regular period, and n cycles are passed among generated N cycles, while (N–n ) of said N cycles are cut away, to redetermine said duty factor as n/N.

23. A color thermal printing method as defined in claim 22, wherein a platen drum supports said recording material, rotates in a single direction, and is set at said first to sixth speeds for first to sixth rotations.

24. A color thermal printing method as defined in claim 23, further comprising steps of:

comparing said first irradiance with a first preset upper limit;

if said first irradiance is equal to or more than said first preset upper limit, then disabling said recording material from having said relative movement at said second speed, without said supplementary fixation of said first coloring layer;

comparing said second irradiance with a second preset upper limit; and if said second irradiance is equal to or more than said second preset upper limit, then disabling said recording material from having said relative movement at said fourth speed, without said supplementary fixation of said second coloring layer.

25. A color thermal printing method as defined in claim 24, further comprising steps of:

actuating said second lamp for said third coloring layer in said thermal recording;

rotating said platen drum at a fifth speed, for said thermal recording to said third coloring layer through said thermal head, and for applying rays to said third coloring layer with said second lamp after said thermal recording;

determining a sixth speed in accordance with said second irradiance; and rotating said platen drum at said sixth speed, for bleaching said third coloring layer with said second lamp.

26. A color thermal printing method as defined in claim 24, wherein said target irradiance is determined equal to or less than said first irradiance, and said duty factor is redetermined as equal to or less than a duty factor of said first drive signal in measurement of said first irradiance.

27. A color thermal printing method as defined in claim 24, further comprising steps of:

comparing said first and/or second irradiance with a preset lower limit;

measuring predetermined time; and if said first and/or second irradiance remains equal to or less than said preset lower limit at a lapse of said predetermined time, disabling said thermal recording, while detecting degradation of said first and/or second lamp.

28. A color thermal printing method as defined in claim 24, further comprising steps of:

detecting, with said sensor, ultraviolet rays from said first and second lamps;

amplifying a signal from said sensor to obtain signals of said first and/or second irradiance; and obtaining a difference between said target irradiance and said first irradiance, said duty factor redetermined in accordance with said difference.

29. A color thermal printing method as defined in claim 28, wherein said first irradiance is detected from a signal in which said sensor signal is amplified, and said second irradiance is detected by further amplification of said amplified signal representing said first irradiance.

* * * * *